US005430424A

United States Patent [19]

Sato et al.

[11] Patent Number: 5,430,424

[45] Date of Patent: Jul. 4, 1995

[54] PLANAR TRANSFORMER

[75] Inventors: Toshiro Sato; Tetsuhiko Mizoguchi, both of Yokohama, Japan

[73] Assignee: Kabushiki Kaisha Toshiba, Kawasaki, Japan

[21] Appl. No.: 209,365

[22] Filed: Mar. 14, 1994

Related U.S. Application Data

[63] Continuation of Ser. No. 890,007, May 29, 1992, abandoned.

[30] Foreign Application Priority Data

May 31, 1991 [JP] Japan ..... 3-130010

[51] Int. Cl.[6] ..... H01F 5/00

[52] U.S. Cl. ..... 336/200; 336/232

[58] Field of Search ..... 336/200, 232, 220, 222, 336/182

[56] References Cited

U.S. PATENT DOCUMENTS

| | | | |
|---|---|---|---|
| 850,863 | 4/1907 | Wooldridge | 336/58 |
| 2,029,779 | 9/1937 | Reitman | 336/182 |
| 2,289,175 | 7/1942 | Boucher . | |
| 2,521,536 | 9/1950 | Reardon | 336/155 |
| 2,782,386 | 2/1957 | Cornell | 336/200 |
| 3,719,911 | 3/1973 | Tomita | 336/196 |
| 4,992,769 | 2/1991 | Oppelt | 336/200 |
| 5,032,815 | 7/1991 | Kobayashi et al. | 336/83 |
| 5,132,650 | 7/1992 | Ikeda | 336/200 X |

FOREIGN PATENT DOCUMENTS

| | | | |
|---|---|---|---|
| 413348 | 2/1991 | European Pat. Off. . | |
| 2525384 | 3/1983 | France . | |
| 114807 | 7/1984 | Japan | 336/200 |
| 2163603 | 2/1986 | United Kingdom | 336/200 |
| 455380 | 2/1973 | U.S.S.R. | 336/200 |

OTHER PUBLICATIONS

Patent Abstracts of Japan vol. 10, No. 244 (E 430) 22 Aug. 1986 & JP-A-61 075-510, Apr. 7, 1986 M Sudo "Small Sized Transformer".

Patent Abstracts of Japan vol. 12 No. 80 (E590) (2927) 12 Mar. 1988 & JP-A-62 219605, Sep. 26, 1987 T. Matsumoto et al. "High Frequency Transformer".

Patent Abstracts of Japan vol. 12 No. 80 (E590) (2927) 12 Mar. 1988. & JP-A-62 219606, Sep. 26, 1987 T. Matsumoto et al., "High Frequency and High Voltage Transformers".

National Convention Record IEE Japan, No. 18-5-5, T. Taniuchi et al.; Mar. 1990 T.S., Nov. 15, 1991 T.M. Mar. 15, 1991 S.18-31 S.18-34.

Technical Report of IEE Japan, No. MAG-91-62, K. Yamaguchi et al. Feb. 8, 1991 pp. 101-110.

*Primary Examiner*—Leo P. Picard

*Assistant Examiner*—L. Thomas

*Attorney, Agent, or Firm*—Oblon, Spivak, McClelland, Maier, & Neustadt

[57] ABSTRACT

Disclosed is a planar transformer comprising a planar primary spiral coil and a planar secondary spiral coil, which are mutually insulated and laminated, wherein, (1) when the winding width $W_1$ of the primary spiral coil and the winding width $W_2$ of the secondary spiral coil have the relationship of $W_1 \leqq W_2$, the inner size $A_{i1}$ of the primary spiral coil and the inner size $A_{i2}$ of the secondary spiral coil coincide with each other, and (2) when the winding width $W_1$ of the primary spiral coil and the winding width $W_2$ of the secondary spiral coil have the relationship of $W_1 > W_2$, the central axes of the primary and secondary spiral coils coincide with each other, the outer size $A_{o2}$ of the secondary spiral coil is equal to or smaller than the outer size $A_{o1}$ of the primary spiral coil, and the secondary spiral coil is arranged corresponding to a position at which magnetic flux generated by a current flowing through the primary spiral coil is largest.

10 Claims, 7 Drawing Sheets

PLANAR TRANSFORMER

This application is a continuation of application Ser. No. 07/890,007, filed on May 29, 1992, now abandoned.

BACKGROUND OF THE INVENTION

1. Field of the Invention

The present invention relates to a planar transformer to be used for various types of circuits such as power supply circuits and inverter circuits for fluorescent tubes.

2. Description of the Related Art

Recently, miniaturization and lightening of all of the electric devices have been strongly required. However, magnetic parts such as inductors and transformers among component parts of electronic circuits have been less miniaturized and lightened than semiconductor elements, resistances and condensers, which becomes a serious reason for preventing the miniaturization and lightening of circuits. Although these magnetic elements are particularly indispensable for various kinds of power inverter circuits, it is difficult to miniaturize and lighten them. In an electronic automatic exchange, for example, many dc-to-dc converters are used in every electronic circuit board in accordance with desired supply voltage, and magnetic elements occupy much of the whole volume of these dc power supplies. The magnetic elements are also used for a back light in the fluorescent tube type utilized for a liquid-crystal display of a word processor or personal computer, and therefore it is indispensable to make magnetic elements thin for a thinner display.

In this circumstance, planar inductors or transformers are greatly developed. When a planar transformer is manufactured, it is necessary to sufficiently increase magnetic coupling between primary and secondary coils in order to efficiently transmit a signal or power from a primary coil to a secondary coil. In other words, it is necessary to design a transformer to make coupling coefficient between both coils as close as possible to 100%. The coupling coefficient k of the transformer is indicated by the following formula $$k=\Phi_{21}\Phi_1,$$

where, $\Phi_1$ indicates magnetic flux produced by the primary coil, and $\Phi_{21}$ indicates magnetic flux which interlinks a secondary coil in the magnetic flux produced by the primary coil.

Provided that a resistance component is negligible, a primary-to-secondary ratio of voltage is proportional to a product of k and the ratio of winding numbers, and signal transmission is completely performed when k is unity. Provided that various kinds of loss are negligible, efficiency of power transmission from a primary coil to a secondary coil is proportional to square of k. Therefore, slight reduction of coupling coefficient causes remarkable reduction of efficiency of power availability. Thus, increasing of coupling coefficient of a transformer is much important for the performance of the transformer.

In general, in order to increase coupling coefficient of a transformer, it is necessary to make a path of magnetic flux produced by a primary coil correspond to that of magnetic flux produced by a secondary coil as much as possible. However, since the distribution of magnetic flux is complicated in the case of a planar transformer, it is difficult to completely realize this condition. Nowadays, there is no unified way of design regarding a method of arranging primary and secondary coils, and this has been decided on the basis of trial and error. When a primary coil remarkably differs from a secondary coil particularly in the winding numbers and sizes, an optimum method of designing coils is not quite obvious from the viewpoint of the performance of the transformer. Accordingly, a planar transformer having a sufficiently high coupling coefficient has not yet been realized for this reason.

As described above, it is expected that a planar transformer will contribute to miniaturization and lightening of electronic circuits. However, a designing method for increasing coupling coefficient has not yet been known so that the planar transformer remains far from practical use.

SUMMARY OF THE INVENTION

The object of the present invention is to provide a planar transformer having high coupling coefficient.

A planar transformer of the present invention comprises a planar primary spiral coil and a planar secondary spiral coil, which are mutually insulated and laminated, wherein, (1) when the winding width $W_1$ of the primary spiral coil and the winding width $W_2$ of the secondary spiral coil have the relationship of $W_1 \leqq W_2$, the inner size $A_{i1}$ of the primary spiral coil and the inner size $A_{i2}$ of the secondary spiral coil coincide with each other, and (2) when the winding width $W_1$ of the primary spiral coil and the winding width $W_2$ of the secondary spiral coil have the relationship of $W_1 > W_2$, the central axes of the primary and secondary spiral coils coincide with each other, the outer size $A_{o2}$ of the secondary spiral coil is equal to or smaller than the outer size $A_{o1}$ of the primary spiral coil, and the secondary spiral coil is arranged corresponding to a position at which magnetic flux generated by a current flowing through the primary spiral coil is largest.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

Figure 1A:
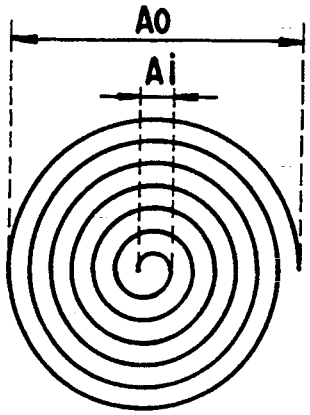
FIGS. 1A–1C are plan views respectively showing the spiral coil used for the planar transformer according to the present invention.
Figure 1B:
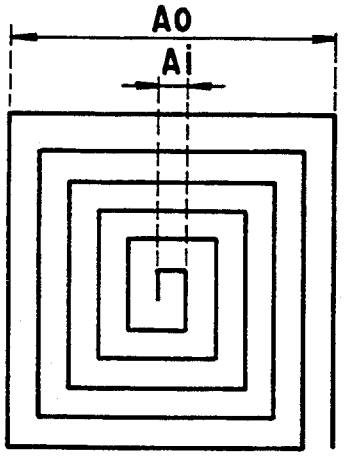
Figure 1C:
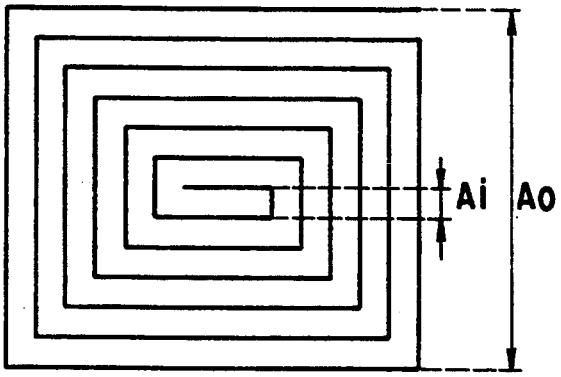

A spiral coil used for the planar transformer of the present invention may be in the round, square, or rectangular shape. FIGS. 1A–1C respectively show these shapes. The outer size of each spiral coil is indicated by $A_o$ and the inner size is indicated by $A_i$. As shown in FIG. 1C, in the rectangular spiral coil, $A_o$ and $A_i$ respectively indicate the size parallel to the short side. Winding width W of each spiral coil is indicated by $$W=(A_o-A_i)/2$$

(1) In the present invention, when the winding width $W_1$ of the primary spiral coil and the winding width $W_2$ of the secondary spiral coil have the relationship of $W_1 \leqq W_2$, the inner size $A_{i1}$ of the primary spiral coil is made to coincide with the inner size $A_{i2}$ of the secondary spiral coil.

Figure 2:
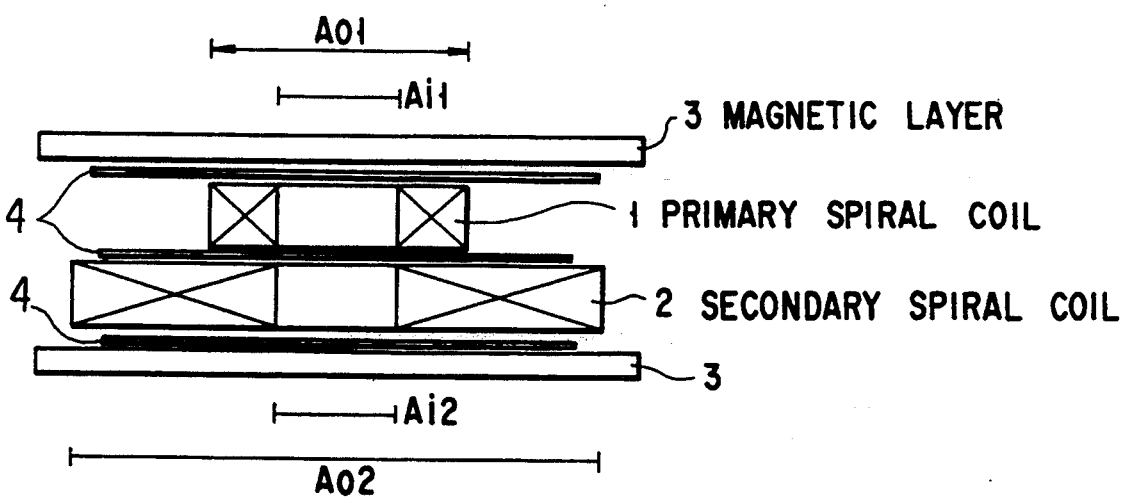
FIG. 2 is a schematic showing a structure of the planar transformer according to the present invention.

FIG. 2 shows a structure of this planar transformer. The primary and secondary spiral coils are mutually insulated and laminated, and an insulating layer 4 and magnetic layer 3 are laminated on both sides of this laminated body. The winding width $W_1$ of the primary spiral coil 1 is smaller than the width $W_2$ of the secondary spiral coil 2, and the inner size $A_{i1}$ of the primary spiral coil is identical to the inner size $A_{i2}$ of the secondary spiral coil.

Figure 3:
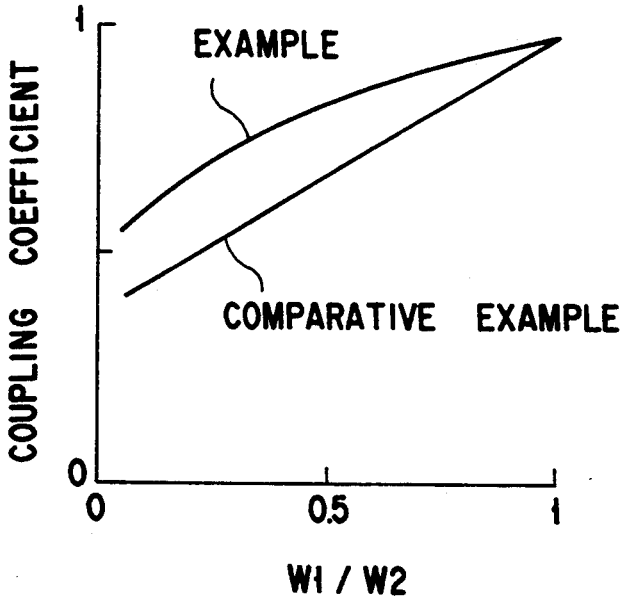
FIG. 3 is a diagram showing the relationship between coupling coefficient k and winding width ratio $W_1/W_2$ of the spiral coils constituting the planar transformer.

FIG. 3 shows the relationship between coupling coefficient k and the ratio of $W_1/W_2$ in the planar transformer of the present invention. This figure shows a case (example) where the inner sizes $A_i$ of the primary and secondary spiral coils are made to coincide with each other, and a case (comparative example) where the outer sizes $A_o$ of the primary and secondary spiral coils are made to coincide with each other. It can be understood from FIG. 3 that the highest coupling coefficient k can be obtained when the ratio of the winding widths of the primary spiral coil to that of secondary spiral coil is unity, and that k reduces as the ratio of $W_1/W_2$ becomes smaller when the inner sizes $A_i$ of the primary and secondary spiral coils are coincide with each other, reduction of k is more gentle than the case where the outer sizes $A_o$ are coincide with each other, and the high coupling coefficient can be sustained even if the ratio of $W_1/W_2$ is smaller than unity.

Figure 4A:
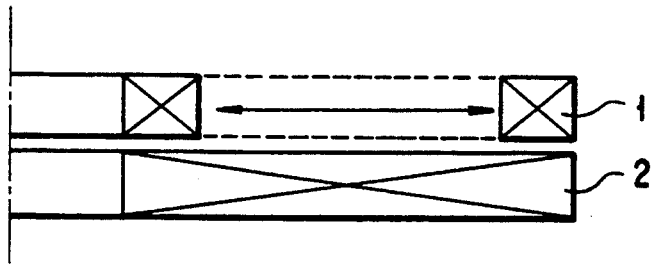
FIG. 4A is a schematic showing a change in position of the primary spiral coil while the secondary spiral coil is fixed.
Figure 4B:
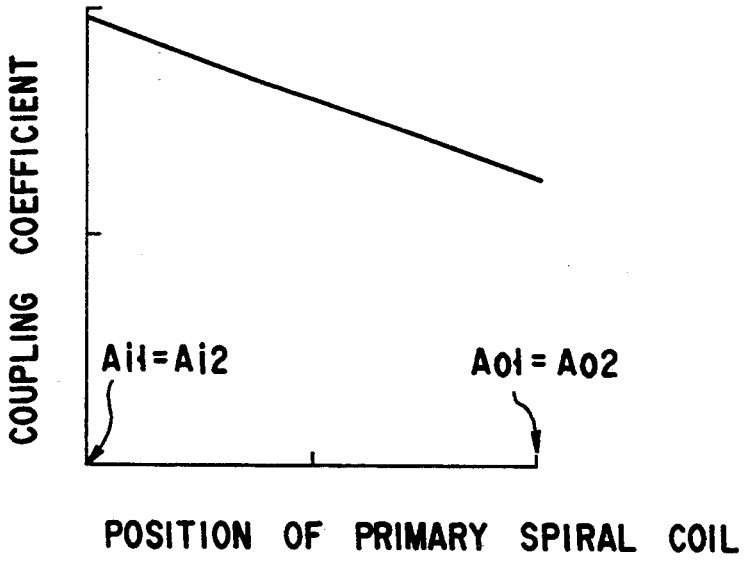
FIG. 4B is a diagram showing the relationship between coupling coefficient k and the position of the primary spiral coil.

FIG. 4A shows a change in position of the primary spiral coil while the secondary spiral coil is fixed as to the planar transformer according to the present invention of which ratio of $W_1/W_2$ is smaller than unity, and FIG. 4B shows the relationship between the position of the primary spiral coil and coupling coefficient k. It can be understood from FIG. 4B that the highest coupling coefficient can be obtained when $A_{i1}$ is identical to $A_{i2}$.

(2) In the present invention, when the winding width $W_1$ of the primary spiral coil and the width $W_2$ of the secondary spiral coil have the relationship of $W_1 > W_2$, the central axes of the primary and secondary spiral coils are made to coincide with each other, the outer size $A_{o2}$ of the secondary spiral coil is made to be equal to or smaller than the outer size $A_{o1}$ of the primary spiral coil, and the secondary spiral coil is arranged corresponding to a position at which magnetic flux generated by a current flowing through the primary spiral coil is largest. It is more preferable to make the center of the winding width $w_2$ of secondary spiral coil to coincide with that position (FIG. 5C).

Figure 5A:
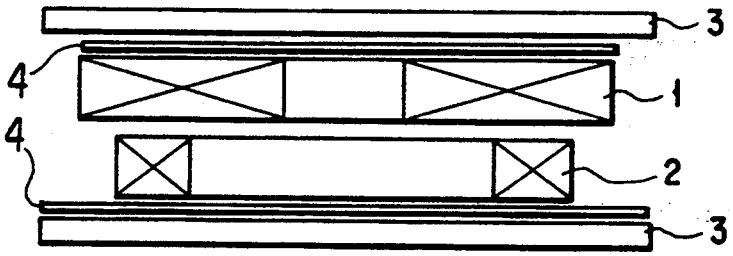
FIG. 5A is a schematic showing a structure of the planar transformer according to the present invention.
Figure 5B:
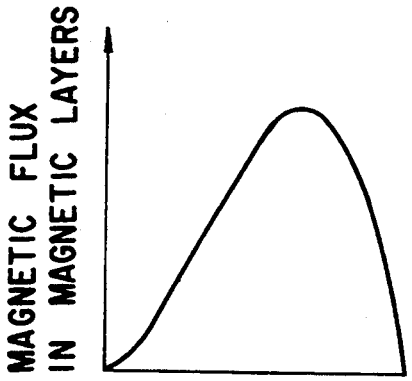
FIG. 5B is a diagram showing the distribution of magnetic flux generated in a magnetic layer by a current flowing through the primary spiral coil.
Figure 5C:
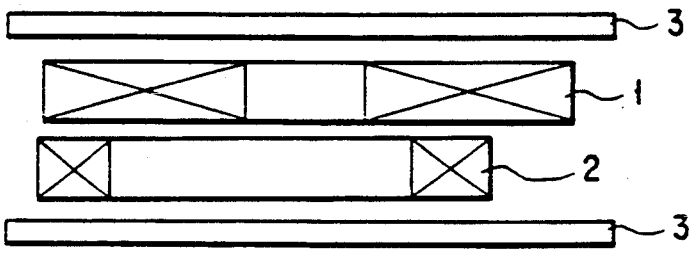
FIG. 5C is a diagram showing the secondary coil at a preferred position.

FIG. 5A shows the structure of this planar transformer. The primary spiral coil 1 and secondary spiral coil 2 are mutually insulated and laminated, and an insulating layer 4 and magnetic layer 3 are laminated on both sides of this laminated body. The central axes of primary spiral coil 1 and secondary spiral coil 2 coincide with each other, and the outer size $A_{o2}$ of the secondary spiral coil is smaller than the outer size $A_{o1}$ of the primary spiral coil. As shown in FIG. 5B, the secondary spiral coil 2 is arranged corresponding to a position at which magnetic flux generated in the magnetic layer 3 by a current flowing through the primary spiral coil 1 becomes greatest.

Figure 6A:
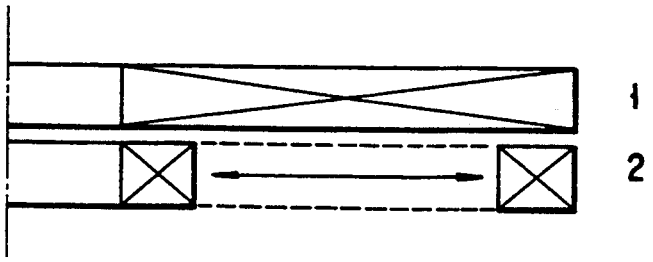
FIG. 6A is a schematic showing a change in position of the secondary spiral coil while the primary spiral coil is fixed.
Figure 6B:
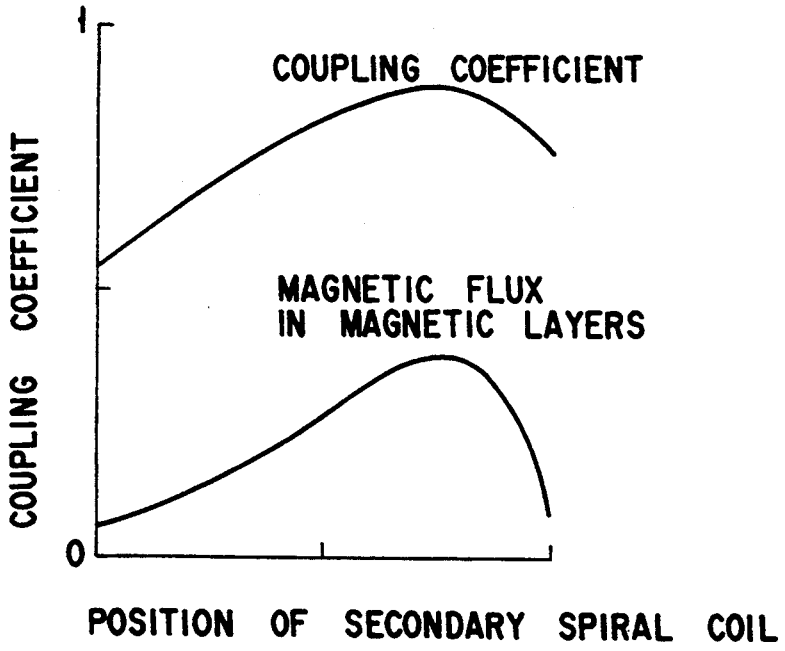
FIG. 6B is a diagram showing the relationship between coupling coefficient k and the position of the secondary spiral coil.

FIG. 6A shows a change in position of the secondary spiral coil while the primary spiral coil is fixed as to the planar transformer according to the present invention of which ratio of $W_1/W_2$ is greater than unity, and FIG. 6B shows the relationship between the position of the secondary spiral coil and coupling coefficient k. This figure also shows the distribution of magnetic flux generated in the magnetic layer by a current flowing through the primary spiral coil. It can be understood from FIG. 6B that the highest coupling coefficient can be obtained when the secondary spiral coil is arranged corresponding to a position at which magnetic flux in the magnetic layer 3 is largest.

Figure 7:
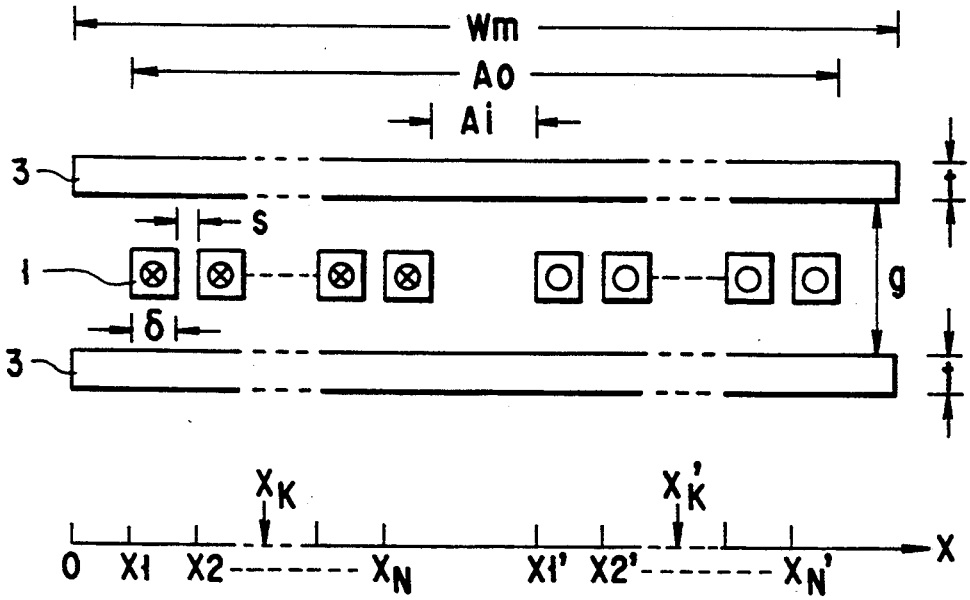
FIG. 7 is a schematic illustrating parameters used for calculation of the distribution of magnetic flux generated in a magnetic layer by a current flowing through the primary spiral coil.

The position at which magnetic flux generated in magnetic layer 3 by a current flowing through the primary spiral coil can be calculated by the following formulas (1) to (4). Each parameter in these formulas will be explained with reference to FIG. 7.

As regards the magnetic layer, $W_m$ indicates a size, $t_m$ a thickness, $\mu_s$ a relative magnetic permeability, and g a gap between the magnetic layers on both sides. The primary spiral coil is interposed between the magnetic layers on both sides. As regards the primary spiral coil, $\delta$ indicates the width of a line of the coil conductor, s a distance between the lines of coil conductor, $A_o$ the outer size, and $A_i$ the inner size. The left end of the magnetic layer is indicated by O, and X-axis extending to the right side along the surface of the magnetic layer indicates the position in the magnetic layer. In the primary spiral coil, there are N numbers of cross sections of lines of the coil conductor at the right and left sides respectively with reference to the central axis. $X_k$ indicates the left end of the cross section of the lines of the coil conductor at the left side to the central axis, and $X_k'$ indicates the left end of the cross section of the lines of the coil conductor at the right side. Therefore, coordinate of $X_k$ and $X_k'$ are expressed by:

$$X_k=(W_m-A_o)/2+(k-1)(\delta+s)$$

$$X_k'=X_N+6+A_i+(k-1)(\delta+s).$$

Formulas (1) to (4) indicate magnetic flux generated in the magnetic layer by a current flowing through the primary spiral coil. Formula (1) indicates magnetic flux at the region in the magnetic layer corresponding to between the left end of the magnetic layer and left end $x_1$ on the cross section of the first line of the coil conductor, formula (2) indicates magnetic flux at the region in the magnetic layer corresponding to the width of the lines of coil conductor, formula (3) indicates magnetic flux at the region in the magnetic layer corresponding to the space between adjacent lines of coil conductor, and formula (4) indicates magnetic flux at the region in the magnetic layer corresponding to between right end $X_N$ on the cross section of the Nth line of the coil conductor and the center of the magnetic layer.

In each formula, $V_i(x)$ indicates a function relating to a magnetic flux component at the region according to the width of each line of coil conductor, $W_i(x)$ indicates a function relating to a magnetic flux component at the left side region of each line of coil conductor placed at the left side to the central axis, $W_i'(x)$ indicates a function relating to a magnetic flux component at the left side of each line of coil conductor placed at the right side to the central axis, and $U_i(x)$ indicates a function relating to a magnetic flux component at the right side of each line of coil conductor placed at the left side to the central axis.

$$0 \leqq x \leqq X_1 \qquad \text{Formula (1)}$$

$$\Phi(x) = \frac{1}{2\delta} \sum_{i=1}^{N} [W_i(x) - W_i'(x)] \cdot L(x)$$

$$X_k \leqq x \leqq X_k + \delta \quad (k = 1, 2, \ldots, N) \qquad \text{Formula (2)}$$

$$\Phi(x) = \frac{1}{2\delta} \left[ \sum_{i=1}^{k-1} U_i(x) + V_k(x) + \sum_{i=k+1}^{N} W_i(x) - W_i'(x) \right] \cdot L(x)$$

$$X_m - s \leqq x \leqq X_m \quad (m = 1, 2, \ldots, N) \qquad \text{Formula (3)}$$

$$\Phi(x) = \frac{1}{2\delta} \left[ \sum_{i=1}^{m-1} U_i(x) + \sum_{i=m}^{N} W_i(x) - \sum_{i=1}^{N} W_i'(x) \right] \cdot L(x)$$

$$X_N + \delta \leqq x \leqq W_m/2 \qquad \text{Formula (4)}$$

$$\Phi(x) = \frac{1}{2\delta} \sum_{i=1}^{N} [U_i(x) - W_i'(x)] \cdot L(x)$$

where, $$U_i(x) = \frac{\cosh[(X_i + \delta/\lambda] - \cosh(X_i/\lambda)}{\sinh(W_m/\lambda)} \cdot \sinh[(W_m - x)/\lambda]$$

$$V_k(x) = 1 - \frac{\cosh(X_k/\lambda) \cdot \sinh[(W_m - x)/\lambda] + \cosh[(W_m - X_k - \delta)/\lambda] \cdot \sinh(x/\lambda)}{\sinh(W_m/\lambda)}$$

$$W_i(x) = \frac{\cosh[(W_m - X_i)/\lambda] - \cosh[(W_m - X_i - \delta)/\lambda]}{\sinh(W_m/\lambda)} \cdot \sinh(x/\lambda)$$

$$W_i'(x) = \frac{\cosh[(W_m - X_i')/\lambda] - \cosh[(W_m - X_i' - \delta)/\lambda]}{\sinh(W_m/\lambda)} \cdot \sinh(x/\lambda)$$

$$\lambda = (\mu_s \cdot g \cdot t_m)^{\frac{1}{2}}$$
$$L(x) = \pi(W_m - 2x) \cdot t_m \cdot \mu_s$$

As described above, the planar transformer with high coupling coefficient can be obtained by determining the positions of the primary and secondary spiral coils.

In the planar transformer according to the present invention, a plurality layers of secondary spiral coils may be used. The planar transformer having such a constitution can generate multi-output voltages.

A method of producing the planar transformer according to the present invention is not specifically limited.

When a thin film process is used, various kinds of thin films such as magnetic material, coil conductor and insulator are formed on an appropriate substrate such as a semiconductor substrate by using methods of spattering, vacuum deposition, CVD, plating, etc. In order to pattern a coil conductor, it is possible to use several kinds of dry etching techniques such as reactive ion etching, ion beam etching and ECR plasma etching, wet etching using an electrolytic solution, and a lift-off method using a photoresist.

On the other hand, soft magnetic foils such as amorphous magnetic foils can be used as magnetic layers in order to mechanically sandwich from both sides of the laminated body of the spiral coils via insulating layers.

As described above, a producing method can be appropriately selected. In any case, it is preferable to reduce the distance between adjacent lines of coil conductor as much as possible in order to strengthen coupling between them.

EXAMPLE 1

The surface of a silicon substrate was heat-oxidized, a CoZrNb amorphous film having a thickness of 2 μm was formed on this substrate by rf spattering method, and further a $SiO_2$ film having a thickness of 1 μm was formed. An AlCu alloy film having a thickness of 10 μm was formed as a coil conductor on the $SiO_2$ film by dc magnetron spattering method, and further a $SiO_2$ film having a thickness of 1 μm was formed by rf spattering method. This $SiO_2$ film was patterned into a square spiral-coil shape, and AlCu alloy film was patterned into the square spiral-coil shape by using the patterned $SiO_2$ film as a mask. In the lower spiral coil (secondary coil), the width of lines of coil conductor was 100 μm, the distance between adjacent lines of coil conductor was 5 μm, the inner size was 1 mm, the outer size was 5.5 mm, and the winding number was 20.

A polyimide film was formed between lines of coil conductor of the lower spiral coil and on them, and was flattened by using an etch-back method. An AlCu alloy film having a thickness of 10 μm and a $SiO_2$ film having a thickness of 1 μm were formed and patterned into a square spiral-coil shape in the same manner as described above. In the upper spiral coil (primary coil), the width of lines of coil conductor is 100 μm, distance between adjacent lines of coil conductor was 5 μm, the inner size was 1 mm, the outer size was 3.3 mm, and the winding number was 10.

A polyimide film was formed between lines of coil conductor of the upper spiral coil and on them and was flattened by using an etch-back method. A CoZrNb amorphous film having a thickness of 2 μm was formed on the film to produce a planar transformer. This planar transformer had the outer size of 6 mm, and a thickness of approximately 0.6 mm including that of the substrate. As described above, the winding width $W_1$ of the upper spiral coil was smaller than $W_2$ of the lower spiral coil, and the inner sizes of both spiral coils were made to coincide with each other.

Electric characteristics were estimated by referring to the upper spiral coil as the primary coil and the lower spiral coil as the secondary coil. The measurement results at a frequency of 5 MHz indicated that primary inductance was approximately 0.9 μH, secondary inductance was approximately 4 μH and mutual inductance was 1.8 μH, and therefore primary-to-secondary coupling coefficient was estimated at approximately 0.95. In this way, a thin-film-type step-up transformer with high coupling coefficient was obtained.

EXAMPLE 2

A thin-film-type step-down transformer was produced in the same manner as described in Example 1. The primary spiral coil had the inner size of 1 mm, the outer size of 5.5 mm, and the winding number of 20, and the secondary spiral coil had the inner size of 2.2 mm, the outer size of 4.5 mm, and the winding number of 10. In this case, the winding width $W_1$ of the primary spiral coil was greater than $W_2$ of the secondary spiral coil. The position at which magnetic flux generated in the magnetic layer by a current flowing through the primary spiral coil would be largest was calculated in advance in accordance with formulas (1) to (4), and the inner and outer sizes of the secondary spiral coil were determined so as to arrange the secondary spiral coil in accordance with the calculated position. In this step-down transformer, primary-to-secondary coupling coefficient was approximately 0.9.

EXAMPLE 3

A copper foil having a thickness of 70 μm and a polyimide sheet having a thickness of 10 μm were laminated and wound, and then molded with an insulating resin. The product was sliced at a thickness of 500 μm to form a planar coil (secondary coil) having a round spiral pattern having the outer diameter of 9 mm, the inner diameter of 4 mm, and the winding number of 30. A planar coil (primary coil) having a round spiral pattern having the outer diameter of 6.5 mm, the inner diameter of 4 mm, and the winding number of 15 was formed in the same manner. A polyimide sheet having a thickness of 7 μm was interposed between both coils, and further polyimide sheets and Co amorphous foils respectively having a thickness of 7 μm were provided on both sides of the laminated coils to produce a planar transformer. This planar transformer had the outer size of 10 mm and a thickness of approximately 1 mm. As described above, the winding width $W_1$ of the primary spiral coil was smaller than $W_2$ of the secondary spiral coil, and the inner sizes of both spiral coils were made to coincide with each other.

An estimation of electric characteristics of this planar transformer indicated that primary inductance was approximately 30 μH, secondary inductance was approximately 7 μH, mutual inductance was 13.5 μH, and therefore primary-to-secondary coupling coefficient was approximately 0.93. In this way, a planar step-up transformer having high primary-to-secondary coupling coefficient was obtained.

EXAMPLE 4

A step-down transformer was produced in the same manner as described in Example 3. The primary spiral coil had the outer diameter of 9 mm, the inner diameter of 4 mm, and the winding number of 30, and the secondary spiral coil had the outer diameter of 8 mm, the inner diameter of 5.5 mm, and the winding number of 15. In this case, the winding width $W_1$ of the primary spiral coil was greater than $W_2$ of the secondary spiral coil. The position at which magnetic flux generated in the magnetic layer by a current flowing through the primary spiral coil would be largest was calculated in accordance with formulas (1) to (4) in advance, and the inner and outer diameters of the secondary spiral coil were determined so that the secondary spiral coil would be arranged in accordance with this position. The primary-to-secondary coupling coefficient of this step-down transformer was 0.92.

As described above in detail, it is possible to increase coupling coefficient in both cases of the step-up and step-down transformers of the present invention by optimizing the relative position of the primary and secondary spiral coils, and therefore excellent effect for improving performance can be obtained.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A planar transformer with increased coupling coefficient comprising:

a primary spiral coil having a first cross-section of primary coil lines with center points lying in a first plane, said primary spiral coil including:

an inner size $A_{i1}$ of the primary spiral coil, $A_{i1}$ being a distance between two inner-most primary coil lines in the first cross-section;

an outer size $A_{o1}$ of the primary spiral coil, $A_{o1}$ being a distance between two outer-most primary coil lines in the first cross-section;

a winding width W1 of the primary spiral coil which is half a difference between the outer size $A_{o1}$ and the inner size $A_{i1}$;

a secondary spiral coil positioned adjacent to the primary coil and having a second cross-section with secondary coil lines with center points lying in a second plane, parallel to the first plane, said secondary spiral coil including:

an inner size $A_{i2}$ of the secondary spiral coil being a distance between two inner-most secondary coil lines in the second cross-section;

an outer size $A_{o2}$ of the secondary spiral coil being a distance between two outer-most secondary coil lines in the second cross-section;

a winding width of the secondary spiral coil W2 which is less than the winding width of the primary spiral coil W1 (W1>W2), said winding width W2 being half of a difference between the outer size $A_{o2}$ and the inner size $A_{i2}$;

wherein, the outer size $A_{o2}$ of the secondary spiral coil is no greater than the outer size $A_{o1}$ of the primary spiral coil; and wherein the primary and the secondary spiral coils are sandwiched between soft magnetic foils with insulating layers between the magnetic foils and primary and the secondary spiral coils.

2. A planar transformer according to claim 1, further comprising:

a magnetic layer sandwiching the primary spiral coil and the secondary spiral coil, wherein a center point of the winding width W2 of the secondary spiral coil is positioned along an x-axis X with respect to the primary spiral coil at a point where the magnetic flux $\Phi(x)$ is at a maximum, the point where the maximum exists determined according to formulas (1) to (4):

$$0 \leqq x \leqq X_1, \quad (X_1 = x, \text{ where a first coil line of the primary spiral coil is positioned along the x-axis}) \qquad \text{Formula (1)}$$

$$\Phi(x) = \frac{1}{2\delta} \sum_{i=1}^{N} [W_i(x) - W_i'(x)] \cdot L(x)$$

$$X_k \leqq x \leqq X_k + \delta, \quad (k = 1, 2, \ldots, N) \qquad \text{Formula (2)}$$

$$\Phi(x) = \frac{1}{2\delta}\left[\sum_{i=1}^{k-1} U_i(x) + V_k(x) + \sum_{i=k+1}^{N} W_i(x) - W_i'(x)\right] \cdot L(x)$$

$$X_m - S \leqq x \leqq X_m, \quad (m = 1, 2, \ldots, N) \qquad \text{Formula (3)}$$

$$\Phi(x) = \frac{1}{2\delta}\left[\sum_{i=1}^{m-1} U_i(x) + \sum_{i=m}^{N} W_i(x) - \sum_{i=1}^{N} W_i'(x)\right] \cdot L(x)$$

$$X_N + \delta \leqq x \leqq W_m/2 \qquad \text{Formula (4)}$$

$$\Phi(x) = \frac{1}{2\delta} \sum_{i=1}^{N} [U_i(x) - W_i'(x)] \cdot L(x)$$

wherein $V_i(x)$ indicates a function relating to a magnetic flux component at the region according to the width of each line of coil conductor; $W_1(x)$ indicates a function relating to a magnetic flux component at a left side region of each line of coil conductor placed at the left side to a central axis; $W'(x)$ indicates function relating to a magnetic flux component at the left side of each line of coil conductor placed at a right side to the central axis; and $U_i(x)$ indicates a function relating to a magnetic flux component at the right side of each line of coil conductor placed at the left side to the central axis; wherein:

$$U_i(x) = \frac{\cosh[(X_i + \delta/\lambda] - \cosh(X_i/\lambda)}{\sinh(W_m/\lambda)} \cdot \sinh[(W_m - X)/\lambda]$$

$$V_i(x) = 1 - \frac{\cosh(X_k/\lambda) \cdot \sinh[(W_m - x)/\lambda] + \cosh[(W_m - X_k - \delta)/\lambda] \cdot \sinh(x/\lambda)}{\sinh(W_m/\lambda)}$$

$$W_i(x) = \frac{\cosh[(W_m - X_i)/\lambda] - \cosh[(W_m - X_i - \delta)/\lambda]}{\sinh(W_m/\lambda)} \cdot \sinh(x/\lambda)$$

$$W_i'(x) = \frac{\cosh[(W_m - X_i')/\lambda] - \cosh[(W_m - X_i' - \delta)/\lambda]}{\sinh(W_m/\lambda)} \cdot \sinh(x/\lambda)$$

$$\lambda = (\mu_s \cdot g \cdot t_m)^{\frac{1}{2}};$$
$$L(x) = \pi(W_m - 2x) \cdot t_m \cdot \mu_s; \text{ and}$$

wherein $W_m$ is a total length of the magnetic layer, $t_m$ is a thickness of the magnetic layer, $\mu s$ is a relative magnetic permeability, g is an inner width of the magnetic layer, $\delta$ indicates a width of an individual coil conductor along the x-axis, s is a distance between individual coil conductors, and ($X_1$, $X_2, \ldots, X_{N-1}, X_N$) are the points along the x-axis where the individual coil conductors begin, $X_N$ corresponding to a last individual coil conductor along the x-axis.

3. The planar transformer according to claim 1, further comprising a magnetic layer laminated on the primary and the secondary spiral coils.

4. The planar transformer according to claim 1, further comprising:

an insulating layer interposed between the primary and the secondary spiral coils.

5. The planar transformer according to claim 4, wherein said insulating layer is polyimide.

6. The planar transformer according to claim 4, wherein each said insulating layer is silicon oxide.

7. The planar transformer according to claim 1 is a dc-to-dc converter.

8. A planar transformer according to claim 1, further comprising:

a first central axis of the primary spiral coil aligned at a center point of the primary spiral coil and perpindicular to the first and the second planes; and a second central axis of the secondary coil aligned at a center point of the secondary spiral coil and perpindicular to the first and the second planes, wherein, the first central axis is aligned with the second central axis to obtain a maximum amount of magnetic flux through the secondary spiral coil.

9. A planar transformer with increased coupling coefficient comprising:

a primary spiral coil having a first cross-section of primary coil lines with center points lying in a first plane, said primary spiral coil including:

an inner size $A_{i1}$ of the primary spiral coil, $A_{i1}$ being a distance between two inner-most primary coil lines in the first cross-section;

an outer size $A_{o1}$ of the primary spiral coil, $A_{o1}$ being a distance between two outer-most primary coil lines in the first cross-section;

a winding width W1 of the primary spiral coil which is half a difference between the outer size $A_{o1}$ and the inner size $A_{i1}$;

a secondary spiral coil positioned adjacent to the primary coil and having a second cross-section with secondary coil lines with center points lying in a second plane, parallel to the first plane, said secondary spiral coil including:

an inner size $A_{i2}$ of the secondary spiral coil being a distance between two inner-most secondary coil lines in the second cross-section;

an outer size $A_{o2}$ of the secondary spiral coil being a distance between two outer-most secondary coil lines in the second cross-section;

a winding width of the secondary spiral coil W2 which is greater than the winding width of the primary spiral coil W1 (W1<W2), said winding width W2 being half of a difference between the outer size $A_{o2}$ and the inner size $A_{i2}$; and wherein, the inner size $A_{i1}$ of the primary spiral coil and the inner size of the secondary spiral coil $A_{i2}$ are set equal.

10. A planar transformer according to claim 2, wherein:

said center point of the winding width of the primary spiral coil is not equal to the center point of the secondary spiral coil on the x-axis.

* * * * *